US005207326A

United States Patent [19]

Benach

[11] Patent Number: 5,207,326

[45] Date of Patent: May 4, 1993

[54] BOOK HOLDER

[76] Inventor: Jose M. Benach, c/o Ganduxer, 15-1° 4a, 08021 Barcelona, Spain

[21] Appl. No.: 944,814

[22] Filed: Sep. 14, 1992

Related U.S. Application Data

[63] Continuation of Ser. No. 712,130, Jun. 6, 1991.

[30] Foreign Application Priority Data

Jun. 15, 1990 [ES] Spain ..... 8902966

[51] Int. Cl.[5] ..... A45F 5/12

[52] U.S. Cl. ..... 206/424; 206/457; 206/804; 206/831; 206/459.5

[58] Field of Search ..... 206/457, 459, 424, 525, 206/526, 804, 831

[56] References Cited

U.S. PATENT DOCUMENTS

| | | | |
|---|---|---|---|
| 923,939 | 6/1909 | Braun | 206/804 X |
| 1,116,043 | 11/1914 | Elliot | 206/831 X |
| 1,586,248 | 5/1926 | Komura | 206/804 X |
| 2,621,785 | 12/1952 | De Pace | 206/424 X |
| 2,800,999 | 7/1957 | Frankenstein | 206/804 X |
| 3,220,625 | 11/1965 | Protheroe | 206/424 X |
| 3,399,762 | 9/1968 | Potter | 206/804 X |
| 3,804,323 | 4/1974 | Bemel | 206/831 X |
| 4,090,608 | 5/1978 | Mc Call | 229/40 X |
| 4,140,257 | 2/1979 | Peterson | 206/804 X |
| 4,700,831 | 10/1987 | Kassai | 206/424 X |
| 4,834,240 | 5/1989 | Dagostine | 206/831 X |
| 5,082,135 | 1/1992 | De Coster | 206/804 X |

FOREIGN PATENT DOCUMENTS 2047860 4/1971 Fed. Rep. of Germany .

*Primary Examiner*—Jimmy G. Foster
*Assistant Examiner*—Jacob K. Ackun, Jr.
*Attorney, Agent, or Firm*—Michael J. Striker

[57] ABSTRACT

The book holder and books, includes a prismatic container having a cover with a foldable flap and a slot for viewing, a base, two side panels extending between the base and the cover and two end panels connected to the base and the side panels to close the container; a plurality of books accommodated in the container; and a rectangular strip having ends and passing underneath the books and extending over the base and both end panels, the ends of the strip extending beyond the end panels. The flap of the cover, which is insertable between the side panel and the books in the closed container, has a plurality of perforations subdividing it into a plurality of rectangular removable pieces, which are detachable to form bookmarks for the books. The books and/or the container can be of such size and have colors and patterns thereon which match the colors and patterns of a pack and/or of cigarettes to help induce consumers to buy books and to reduce smoking.

14 Claims, 2 Drawing Sheets

BOOK HOLDER

This application is a continuation of application Ser. No. 712,130, filed Jun. 6, 1991.

BACKGROUND OF THE INVENTION

The present invention relates generally to book holders.

There exist on the market, and in the publishing sector in particular, certain types of book collections with different themes, presented to the public in containers of different shapes. The purpose of the containers is to store the books making up the collection, being related to each other by title, color, or patterns. It is usual that all of the books in a single collection are uniformly bound, but the binding of the books is completely different from that of the container, the only purpose of which is to allow better placement and ordering of the collection of books that it holds.

The current tendency in all countries, as relates to the consumption of tobacco, is to stimulate through the various national administrations by means of a series of measures restriction of tobacco consumption, as well as the places and areas where smoking may be carried out, with the clear objective of eliminating its consumption in a very long term.

SUMMARY OF THE INVENTION

The objective of this invention is a book holder and books having many advantages including stimulation of desire to read instead of smoke.

In keeping with these objects, the book holder and books of the present invention comprise a container having a cover, a base, two side panels extending between the base and the cover and two end panels connected to the base and the side panels, an outer surface of the container being provided with patterns and/or colors, especially patterns and/or colors similar to those on a carton of cigarettes; a plurality of books accommodated in the container; means for viewing at least a portion of the books including at least one slot formed in the container, particularly in the cover of the container; and means for facilitating removal of the books from the container including a strip having ends and passing underneath the books and extending over the base between the end panels and also passing between the books and both end panels from the base, the ends of the strip extending beyond the end panels. The cover includes a plurality of removable pieces. Each of these pieces is detachable from the cover, advantageously by perforations in a foldable flap of the cover, to form a bookmark for the books held in the container. When the book holder is designed in accordance with the present invention it offers sets of books, in series according to genre or matters, housed in cases which will call to mind the cartons of ten packs of cigarettes commercialized on the international tobacco market. Each book will have, in turn, the miniature dimensions identical to those of a common pack of 20 cigarettes predominantly commercialized within the sector.

In accordance with this adequate value should be placed on the twofold aspect of the unprecedented object proposed. First, it is worth pointing out the influence on book acquisition of a unique and attractive product, specially and carefully conceived in content and design, capable of winning over habitual book customers as well as the massive sectors of society who are not usual readers and are completely unaffected by any quality publishing offer with a cultural, literary or purely intrinsical aspect.

And secondly, it is essential, obviously, that the most original and innovative facet of the invention be appreciated; that being the fact that it is overtly aimed at the sector of tobacco consumption, infinitely stronger as relates to the number of consumers and volume of sales, than the publishing sector. The breaking of ground in this area by means of the appropriate conceptual and iconographic language, must allow for playing with provocations, subtleties and paradoxes, destined to stimulate a "linking" for the next product on a massive scale, and as a result, to increase its commercial success.

In addition, the colors and patterns appearing on the containers housing the collections, will be related in terms of the type of literature or the subject matter of the books contained in the above mentioned container. An example of which might be the use of black, or similarly colored, patterns used to correspond to the literary genre commonly known as the "black series", i.e. the detective novel. In this manner, a direct relationship is established between the colors and the literary genre, and between the patterns on the container, and those on the bindings of the hooks it contains, offering access to information on the books contained in its interior by means of slots cut out of the both larger upper and lower bases of the container.

And in addition to all of this, a third effect, beneficial from the point of view of the objectives expressed above, must be pointed out; said effect being to achieve an association in the mind of the tobacco consumer who will lose the habit of associating a determinate pattern representing a brand of cigarettes, with the contents of the container holding the packs of cigarettes bearing the same pattern.

Other details and characteristics of this invention a will be disclosed in the course of the description that follows, in which reference will be made to the drawings. In this description, the preferred details will be represented in a somewhat schematic manner. These details are provided to serve as an example, making reference to one possible case of actual practice, but with no limitation regarding the details set forth therein. Therefore, this description should be considered as illustrative and not in any way limited to the details provided.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
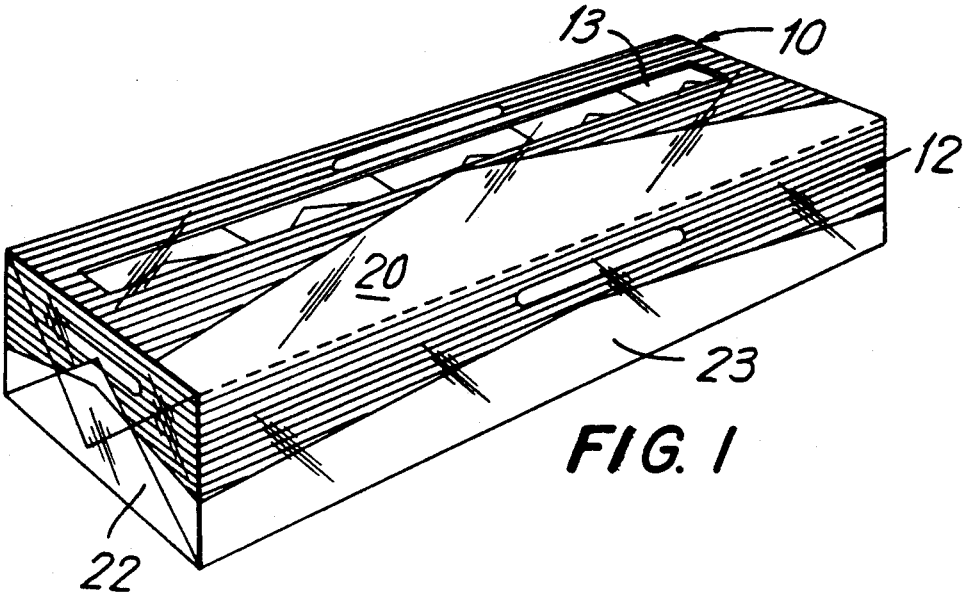
FIG. 1 is a perspective view of a book holder and a plurality of books according to the invention.

A book holder and books according to the invention are shown in the drawing. The book holder comprises a container 10 having an outer surfaces bearing patterns a useful in selling the book holder and its contents. The container 10 is prismatic and comprises a base or lower panel 21, an upper panel 20 and two side panels 23 extending between the upper panel 20 and the base 21. The container is closed on both ends with end panels 22 which are each connected to one end of the side panels 23 and the base 21.

A plurality of books 11 is accommodated in the container 10 and the container 10 is provided with a slots 13 in the upper panel 20 through which the titles T of the books can be read. The slot 13 is substantially rectangular in the embodiment shown in the drawing. It is also possible to provide another slot for viewing in the lower panel or base 21 of the container 10, since the books 11 in the preferred embodiment are arranged in two layers. Thus the titles T in the lower layer of books can be read through the other slot in the base 21 of the container 10.

The book holder is also provided with a strip 14 which facilitates removal of all the books 11 from the container 11. This strip 14 is rectangular in the preferred embodiment and is comparatively longer than it is wide. When the books 11 are held in the container 11 with the upper panel 20 closed as in FIG. 1, the rectangular strip 14 extends underneath the books 11 and along and over the inner surface of the base 21 and also extends between the books 11 and both end panels 22. The ends of the strip 14 extend beyond the end panels 22 and are folded over the books 11 and are between the books 11 and the upper panel 20 in FIG. 1.

Figure 2:
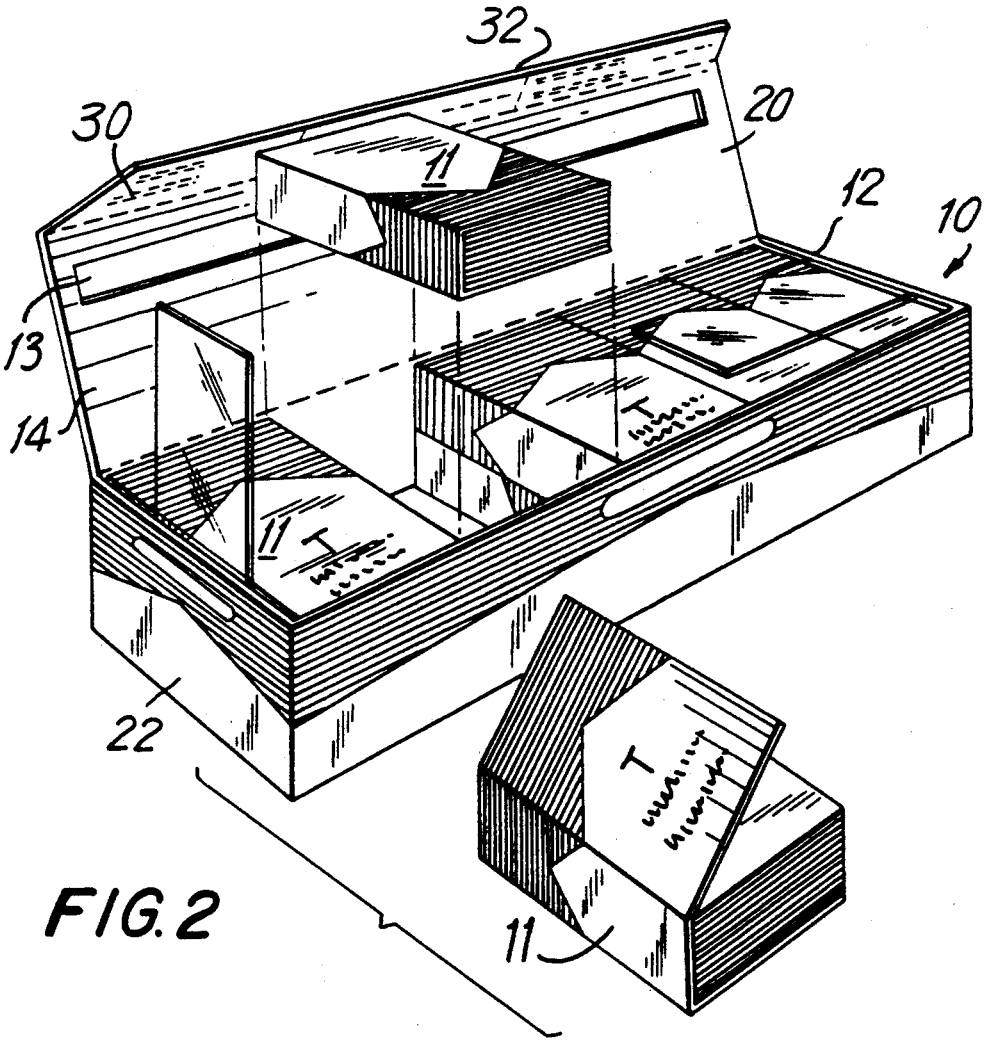
FIG. 2 is an exploded perspective view of the book holder and plurality of books shown in FIG. 1 showing the container open with a book removed from the container.

The upper panel 20 of the container 10 is a cover movable between an open and a closed position as shown in FIGS. 1 and 2 and is hingedly connected to one of the side panels 23. The cover 20 also has a foldable flap 32 which is inserted between the books 11 and one of the side panels 23 when the container is closed as shown in FIG. 1. The flap 32 has a plurality of perforated lines subdividing it into a plurality of bookmarks 30 which are of a size so that they can be used with the books 11 in the container.

In the preferred embodiment the container 10 has a pattern 12 on its exterior surface on every face of the container 10 representative of an imaginary brand of cigarette. The container 10 thus appears to be the same as a carton of cigarettes which are usually marketed and above all and fundamentally produces the evocative effect that is desired in the consumer.

Figure 3:
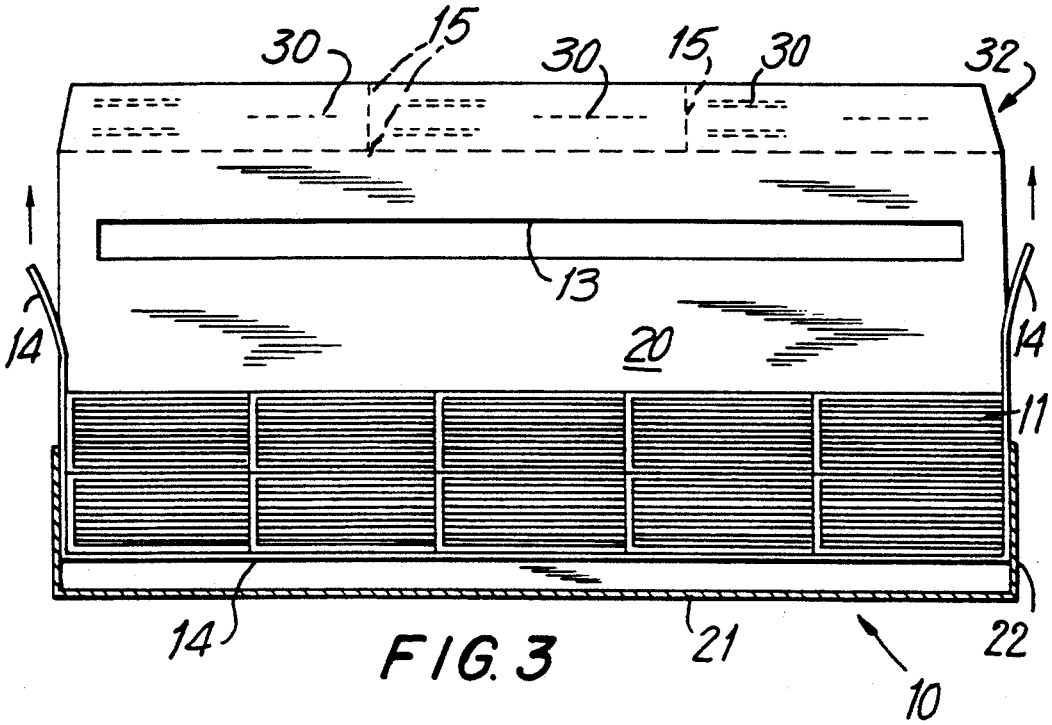
FIG. 3 is a cross-sectional view through the book holder and books shown in FIG. 2.
Figure 4:
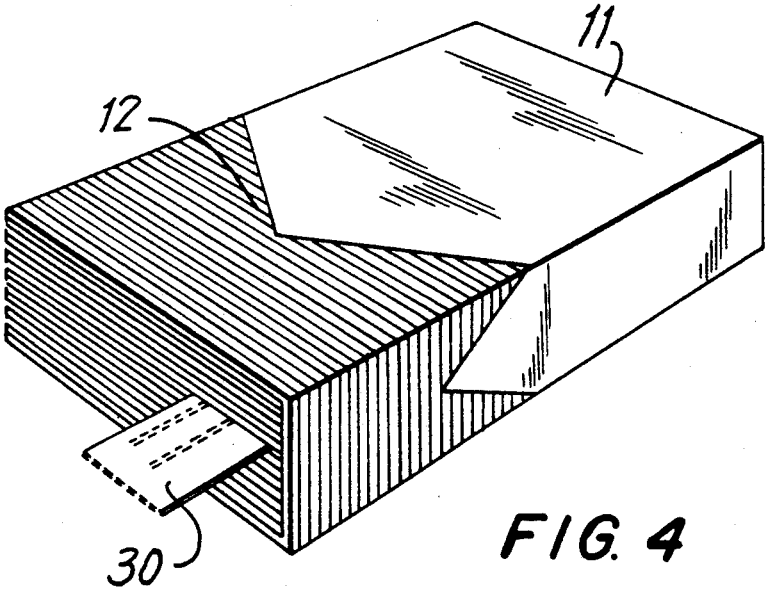
FIG. 4 is a perspective view of a book taken from the container with a bookmark in it.

In operation, the titles of the books are viewed through the slot 13 in the closed container 10. The selection is made by the consumer, the container 10 is purchased and subsequently opened by lifting the cover. Then as shown in FIGS. 2 and 3 the ends of the strip 14 passing under all the books are lifted so that the books 11 are raised and the desired book 11 is removed from the plurality of books 11. Then the remaining books are lower back into the container 10. The consumer-reader then can detach a bookmark 30 from the flap 32 of the cover so that he can mark his place in the book 11 when he is finished reading with the properly sized bookmark 32 as shown in FIG. 4.

The patterns 12 on the container 10 can be made to correspond or agree with the patterns on the books 11. The patterns and colors 12 of the container 10 and the books 11 can be evocative of a particular literary genre. For example, a romance novel which could be pink, a detective novel which could be black, and so forth.

While the invention has been illustrated and described as embodied in an improved book holder and books, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. A book holder and books, comprising a container having a cover, a base, two side panels extending between the base and the cover and two end panels connected to the base and the side panels and also having an outer surface provided with patterns; a plurality of books accommodated in said container; means for viewing at least a portion of said books, said means for viewing including at least one slot formed in said container; and means for facilitating removal of said books from said container, said means for facilitating removal including a strip having ends and passing underneath said books and extending over an inner surface of said base between said end panels and passing between said books and said end panels from said base, said ends of said strip extending beyond said end panels; and wherein the cover includes a plurality of perforation means for dilineating a plurality of removable pieces, each of said pieces being detachable from said cover to form a bookmark for the books held in the container.

2. A book holder and books as defined in claim 1, wherein said books are provided with patterns which are identical to said patterns of said outer surfaces of said container.

3. A book holder and books as defined in claim 1, wherein said container has colors provided on said outer surface, said books having colors which are identical with the colors of said outer surface of said container.

4. A book holder and books as defined in claim 1, wherein said container is dimensioned like a carton for cigarettes and said books are shaped and dimensioned like packs of cigarettes so as to provide tobacco consumers with means for reducing a craving for cigarettes.

5. A book holder and books as defined in claim 1, wherein said books are arranged in two layers, one of the layers being adjacent and closest to the base and the other of the layers being adjacent and closest to the cover and the means for viewing includes two slots, one of the slots being in the cover and the other of the slots being in the base.

6. A book holder and books as defined in claim 1, wherein said container is substantially prismatic.

7. A book holder and books as defined in claim 1, wherein said slot is substantially rectangular.

8. A book holder and books as defined in claim 1, wherein said strip passing underneath said books is substantially rectangular.

9. A book holder as defined in claim 1, wherein each of said pieces forming said bookmarks are substantially rectangular.

10. A book holder and books, comprising a prismatic container having a cover, a base, two side panels extending between the base and the cover and two end panels connected to the base and the side panels to close the container, said cover being hingedly connected to one of the side panels and having a foldable flap; a plurality of books accommodated in said container, said cover having at least one slot as a means for viewing at least a portion of said books; and a rectangular strip having ends and passing underneath said books and extending over and along said base between said end panels and also passing between said books and both of said end panels from said base, said ends of said strip extending beyond said end panels; and wherein the flap of the cover has a plurality of perforations subdividing the flap into a plurality of rectangular removable pieces, each of said pieces being detachable from said cover to form a bookmark for the books held in the container.

11. A book holder and books as defined in claim 10, wherein said container has an indicating means for indicating the literary genre of the books held therein.

12. A book holder and books as defined in claim 11, wherein said indicating means is a colored pattern.

13. A book holder and books as defined in claim 10, wherein said container is provided with patterns and colors and said books have patterns and colors identical to said container.

14. A book holder and books as defined in claim 13, wherein said books are designed to look like a pack of cigarettes and said container is designed to look like a carton of cigarettes.

* * * * *